US008907196B2

(12) United States Patent
Vainiala

(10) Patent No.: US 8,907,196 B2
(45) Date of Patent: Dec. 9, 2014

(54) METHOD OF SOUND ANALYSIS AND ASSOCIATED SOUND SYNTHESIS

(76) Inventor: Mikko Pekka Vainiala, Pori (FI)

( * ) Notice: Subject to any disclaimer, the term of this patent is extended or adjusted under 35 U.S.C. 154(b) by 116 days.

(21) Appl. No.: 13/554,219

(22) Filed: Jul. 20, 2012

(65) Prior Publication Data

US 2013/0019739 A1 Jan. 24, 2013

(51) Int. Cl.

| | |
|---|---|
| ***G10H 7/00*** | (2006.01) |
| ***G10H 1/00*** | (2006.01) |
| ***H04R 3/04*** | (2006.01) |

(52) U.S. Cl.

CPC ..... *G10H 1/0091* (2013.01); *G10H 2210/265* (2013.01); *H04R 3/04* (2013.01)

USPC ..... 84/622; 84/603; 84/609; 84/649; 84/659

(58) Field of Classification Search

None

See application file for complete search history.

(56) References Cited

U.S. PATENT DOCUMENTS

| | | | | |
|---|---|---|---|---|
| 4,984,495 | A | 1/1991 | Fujimori | |
| 8,538,042 | B2 * | 9/2013 | Yang et al. | 381/103 |
| 2005/0108004 | A1 * | 5/2005 | Otani et al. | 704/205 |
| 2007/0193435 | A1 * | 8/2007 | Hardesty et al. | 84/609 |
| 2011/0038490 | A1 * | 2/2011 | Yang et al. | 381/103 |
| 2013/0343573 | A1 * | 12/2013 | Yang et al. | 381/103 |

FOREIGN PATENT DOCUMENTS

| | | | |
|---|---|---|---|
| EP | 0505949 | A1 | 9/1992 |
| JP | 05027770 | A | 2/1993 |
| JP | 2003050582 | A | 2/2003 |
| WO | 0028521 | A1 | 5/2000 |
| WO | 2011019339 | A1 | 2/2011 |

OTHER PUBLICATIONS

European Search Report. Application No./Patent No. 12005290.7-2225. Date of completion of the search: Nov. 21, 2012.

Dolphin Music, "Universal Audio Premiers Studer A800 Multichannel Tape Recorder Plug in for UAD-2", Dec. 7, 2010, http://www.dolphinmusic.co.uk/article/4639-universal-audio-premiers-studer-a800-multichannel-tape-recorder-plug-in-for-uad-2.html [accessed Nov. 14, 2011].

United Kingdom Intellectual Property Office Search Report. Application No. GB1112675.2. Date of search: Nov. 15, 2011.

United Kingdom Intellectual Property Office Search Report. Application No. GB1112676.0. Date of search: Nov. 14, 2011.

* cited by examiner

*Primary Examiner* — Marlon Fletcher

(74) *Attorney, Agent, or Firm* — Mollborn Patents, Inc.; Fredrik Mollborn

(57) ABSTRACT

A sound analysis and associated sound synthesis method is provided. A first input sound signal is received and analyzed, to determine its corresponding impulse response representative of a timbre of the input sound signal. A second input sound signal is received and processed into a form which the corresponding impulse response is susceptible to being applied, wherein the processing includes generating a "pink noise" equivalent frequency spectrum of the second input sound signal. The impulse response is applied to the processed second input sound signal to generate an output signal, wherein the output sound signal includes at least timbral nuances of the first input sound signal.

9 Claims, 2 Drawing Sheets

METHOD OF SOUND ANALYSIS AND ASSOCIATED SOUND SYNTHESIS

CROSS-REFERENCE TO RELATED APPLICATIONS

This application claims priority to United Kingdom Patent Application No. 1112676.0 filed on Jul. 22, 2011, the entire content of which is incorporated herein by reference.

FIELD OF THE INVENTION

The present invention relates to methods of sound analysis and associated sound synthesis, for example in real time; for example, the present invention relates to methods of analyzing sounds for determining their timbral characteristics, and then applying the timbral characteristics onto another sound in real time. Moreover, the present invention also concerns apparatus operable to execute aforesaid methods. Furthermore, the present invention relates to software products recorded on machine-readable data storage media, wherein the software products are executable upon computing hardware for implementing aforesaid methods.

BACKGROUND

When a band of musicians or an individual musical artist is desirous to making a recording, for example a record or album, it is beneficial to use facilities included in a recording studio. In its most basic form, a recording studio includes a room in which the band or artist is located when making music, a control room for a recording engineer, together with recording gear. The recording gear includes equipment such as microphones, cables, monitor speakers and a multitrack recorder. Optionally, the multitrack recorder is implemented digitally using an AD-converter, a DA-converter and a personal computer executing appropriate multitrack recording software. Alternatively, the multitrack recorder is implemented as a more conventional electromechanical device using magnetic recording tape.

It is contemporarily feasible to implement a professional home recording studio provided that a skilled recording engineer is employed to operate the studio and other associated equipment such as microphones are of sufficiently high quality. In the year 2011, it is estimated that professional-quality recording equipment needed for implementing a small home recording studio is in an order of Euro 5000. If a personal computer is employed for the multitrack recorder, for example a laptop computer, the equipment for implementing the recording studio is potentially highly portable. However, expensive home recording studios are also purchasable, for example a proprietary Pyramix mastering workstation is estimated to cost in an order of 20000 USD (USD=United States dollars).

When employing an aforementioned contemporary studio, an actual recording process involves each musician playing his or her part separately to provide a plurality of "takes", and then the takes are combined in a mixing process where characteristics of each take is individually adjustable so as to obtain a preferred balance between the takes. For example, in a case of recording a rock band at a home studio, a drummer of the band would be recorded first to provide a drummer take, typically whilst hearing a demo guitar and demo bass via headphones so as to obtain a correct duration of musical bars to the recording. Optionally, the demo guitar and demo bass, via their respective musicians, are played together with the drummer in a manner such that guitar and bass amplifiers are located in a separate room to avoid their sound contribution being included into the drummers take; the sound of the guitar and bass is transduced using microphones and corresponding microphone signals mixed together to generate a corresponding mixed signal which is then employed to drive headphones of the drummer, and of the musicians playing the bass and guitar. However, the guitar and bass signals are not recorded at this point to provide corresponding takes of the bass and the guitar, because their sole purpose is to guide the drummer when playing to provide the drummer take.

Often, after several repetitions and corresponding recordings, a recording engineer and members of the rock band are satisfied with the drummer take, the activities are then focused to generate a bass take, namely bass guitar take. During recording of the bass take, the bass guitar musician is provided with a replay of the drummer take via headphones, optionally together with the demo guitar. This process of progressing recording takes is repeated until takes for all members of the rock band have been recorded by the recording engineer.

After the takes have been completed, a mixing engineer fine-tunes each of the takes individually, normally starting with the drummer take. Optionally, the takes are mixed to generate a composite track by way of a mixing process that is optionally executed in the aforesaid control room; beneficially, the control room is an acoustically treated room including high-quality loudspeakers and a computer. For example, the control room is acoustically treated room, which is substantially devoid of natural reverberation. The mixing engineer is operable to add various sound effects to the takes, for example signal limiting, equalization, dynamic range compression and so forth when generating the composite track until the musicians in the band are satisfied with the composite track. Whilst adjusting a given take, namely "track", the mixing engineer ensures that respective timbres of the takes are mutually compatible when mixing to generate the composite track. The composite track substantially corresponds to a final mix which is eventually for broadcast, sale via data carriers such as CD's and records, or otherwise disseminated to the public, although certain mastering adjustments to the composite track are often implemented in practice for obtaining a best rendition in the final mix. A total number of takes mixed together to form a corresponding composite track often includes several dozen takes, and preparation of a composite track take often require hours, days, even weeks of work. The composite tracks are included together by a mastering engineer to provide a final album for dissemination to the public.

The mastering engineer has a task of finalizing an overall sound of the album. The mastering engineer is thus operable to execute a mastering process, which is usually implemented much faster than aforesaid mixing activities implemented by the mixing engineer. Typically, the mastering process is executed within a couple of days. For example, the mastering engineer has a task of making the album sound as loud as possible when program material pertains to rock music. Human appreciation of sound, namely a combination of human ear activity and human brain activity, finds louder sounds more interesting than quieter sounds. Since the album producing process executed by the mastering engineer cannot in practice influence a volume setting of a consumers earpiece, the mastering engineer is operable to apply certain audio effects, which cause the sound to be perceived on listening to be louder than it actually is in reality. These effects include dynamic compression as well as an addition of subtle distortion effects.

Since given rock bands and record producers desire that listeners, namely customers, to find their particular albums more interesting in comparison to competing artists and albums, a generally similar loudness enhancing maximization is applied on all contemporary rock records and similar, with a consequent result that most contemporary rock band albums sound mutually equally loud, too mutually similar and fatiguing to listeners.

Contemporary albums involve slow and tedious manual work on the part of the recording engineer, the mixing engineer and the mastering engineer, as well as the musicians, for example during mastering and especially mixing of takes. Such work involves experimenting with different mixes, whereas work involved with overall sounds of rock bands or artists is kept to a minimum. Consequently, artistic freedom becomes limited on account of mixing and mastering engineers not being inclined to take risks and potentially jeopardize several days' work. Moreover, since home recording studios have become more common, the artist, the recording engineer, the mixing engineer, the mastering engineer, as well as the produce for albums produced by the home studio are often implemented by one person.

Clearly, a contemporary need arises for sound processing methods which enable recordings in albums to be enhanced which enables them compete better against other albums.

In a published U.S. Pat. No. 4,984,495 ("Musical Tone Signal Generating Apparatus", Applicant—Yamaha Corp.; inventor—Fujimori), there is described a musical tone signal generating apparatus. The apparatus is implemented such that first sampling data and second sampling data are multiplied together by a convolution operation, wherein the first sampling data indicates instantaneous amplitude values of a musical tone waveform generated from a keyboard, for example. The second sampling data is obtained from an impulse response waveform signal indicative of a reverberation characteristic of a room or an acoustic characteristic of an amplifier or musical instrument such as a guitar or a piano. Alternatively, the second data can be obtained from a waveform signal indicative of an animal sound, a natural sound or the like. Then, the multiplication result of the first and second sampling data is combined together into the musical tome waveform data, whereby a musical tone signal corresponding to this musical tone waveform data is generated. Thus, the musical tone is modulated with another sound such that the reverberation or acoustic characteristic will be simulated in the musical tone to be generated, whereby the variable musical effect can be applied to the musical tone.

SUMMARY

The various embodiments of the present invention seeks to provide an improved sound analysis and associated sound synthesis method which is capable of copying timbral characteristics from one signal onto another by way of one or more impulse responses.

According to a first aspect, there is provided a sound analysis and associated sound synthesis method as claimed in appended claim 1: there is provided a sound analysis and associated sound synthesis method, wherein the method includes:

(a) receiving a first input sound signal;

(b) analyzing the input sound signal to determine its corresponding impulse response representative of a timbre of the input sound signal;

(c) receiving a second input sound signal;

(d) processing the second input sound signal into a form to which the corresponding impulse response is susceptible to being applied, wherein said processing includes generating a "pink noise" equivalent frequency spectrum of the second input sound signal; and (e) applying the impulse response to the processed second input sound signal to generate an output signal, wherein the output sound signal includes at least timbral nuances of the first input sound signal.

The embodiment is of advantage in that the method is capable of applying timbral nuances to the second signals when generating the corresponding output sound signal.

Optionally, the method is implemented in real time using software products executing upon computing hardware.

Optionally, the method is implemented such that multiple impulse responses from (b) are stored on a database, and are user-selectable for applying to the second input sound signal.

Optionally, the method is implemented such that steps (b) and (e) employ at least one of: signal delay functions, signal resonance functions, non-linear functions, Fourier transform functions.

Optionally, the method is implemented such that step (d) includes generating a "pink noise" equivalent frequency spectrum of the second input sound signal. More optionally, the method is implemented such that step (d) includes adding distortion of a form associated with magnetic tape recorders.

Optionally, the method is implemented such that steps (b) and (d) include a signal loudness estimation, for use in step (e) for adjusting the loudness of the processed sound.

Optionally, the method is adapted for applying timbral characteristics corresponding to thermionic electron tube amplifiers.

According to a second aspect, there is provided an apparatus operable to execute a method pursuant to the first aspect of the invention, wherein the apparatus includes:

(a) a receiver for receiving a first input sound signal;

(b) an analyzer for analyzing the input sound signal to determine its corresponding impulse response representative of a timbre of the input sound signal;

(c) a receiver for receiving a second input sound signal;

(d) a processor for processing the second input sound signal into a form to which the corresponding impulse response is susceptible to being applied, wherein the processing includes generating a "pink noise" equivalent frequency spectrum of the second input sound signal; and (e) a processor for applying the impulse response to the processed second input sound signal to generate an output signal, wherein the output sound signal includes at least timbral nuances of the first input sound signal.

According to a third aspect, there is provided a software product recorded on a machine-readable data storage medium, wherein the software product is executable upon computing hardware for implementing a method pursuant to the first aspect of the invention.

It will be appreciated that features of the invention are susceptible to being combined in various combinations without departing from the scope of the invention as defined by the appended claims.

DESCRIPTION OF THE DRAWINGS

Embodiments of the present invention will now be described, by way of example only, with reference to the following drawings wherein.

Figure 1:
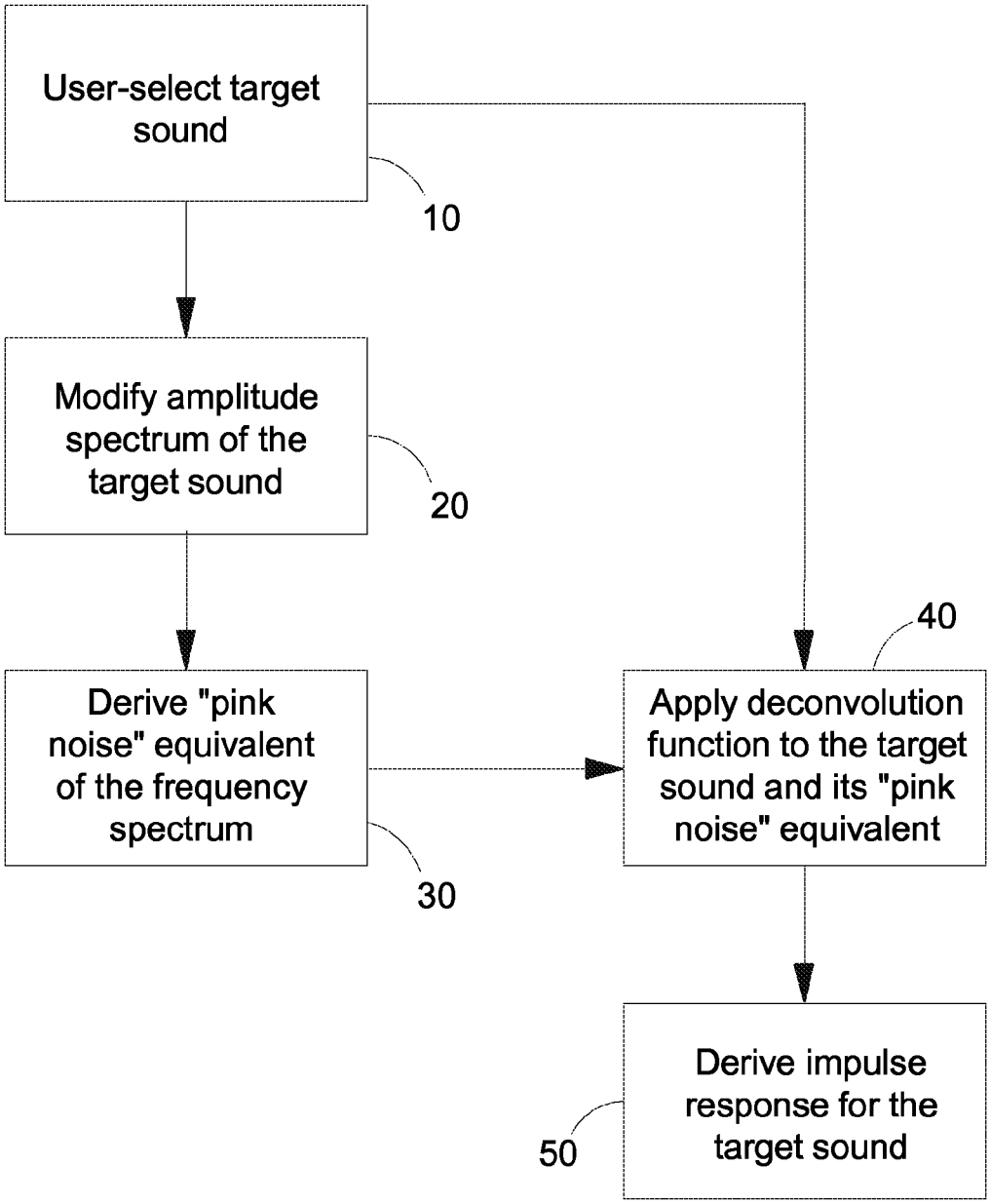
FIG. 1 is an illustration of steps of an embodiment of a sound analysis method pursuant to the present invention.

In the accompanying drawings, an underlined number is employed to represent an item over which the underlined number is positioned or an item to which the underlined number is adjacent. A non-underlined number relates to an item identified by a line linking the non-underlined number to the item. When a number is non-underlined and accompanied by an associated arrow, the non-underlined number is used to identify a general item at which the arrow is pointing.

DETAILED DESCRIPTION

In overview, the various embodiments of the present invention are concerned with methods of sound analysis and sound synthesis, for example methods of analyzing sounds for determining timbre as represented by a set of parameters, and then applying these parameters via sound synthesis to process other sounds to impart thereto the analyzed timbre. The method is, for example, potentially applicable to takes used for producing albums for imparting greater interest to other sounds included in the albums.

If one hears two equally loud notes, for example middle-C played on a clarinet and on a guitar, it is possible for a human being to distinguish between the sounds even though they are of nominally similar pitch and amplitude. Such distinguishing is governed by several factors such as harmonic development, sound attack characteristics, sound decay characteristics and subtle harmonic instabilities arising when the notes are being sounded. The notes are beneficially analyzed as a series of harmonic components in a spectrum, wherein the harmonic components are a function of time from when the note is initially sounded.

For example, sounds that change with time are a piano tone. Firstly, there is a thump of a piano hammer hitting a piano string, immediately followed by a bright sustained ringing tone of the piano string, which gradually becomes mellower and finally fades out. Thus, if a spectrum of an entire piano note were graphically plotted as a function of time, it would contain a sonic average of the initial thump, the bright ringing part, and the mellower fading part, all mixed together in a temporally changing sequence. Thus, the tone of the piano can be represented by Equation 1 (Eq. 1):

$$S(t) = \sum_{i=1}^{n} k_i(t)\sin(i\omega_A t + \phi_i(t)) + \sum_{j=1}^{m} h_j(t)\sin(j\omega_B t + \theta_j(t))$$

wherein

S(t)=a signal corresponding to the piano tone;

$\omega_A$=a fundamental tone angular frequency for the piano tone;

$\omega_B$=an angular frequency for inharmonic components of the piano tone;

i=harmonic number;

j=inharmonic number;

n=number of harmonics required to represent a timbre of the piano tone;

m=number of inharmonic components required to represent inharmonic features of the piano tone;

k=coefficient defining amplitude of the harmonic i;

h=coefficient defining amplitude of inharmonic component j;

$\phi$=relative phase of harmonic i;

$\theta$=relative phase of inharmonic component j; and t=time.

It will be appreciated from Equation 1 (Eq. 1) that faithful representation of a piano tone is potentially highly complex. It is thus commonplace for contemporary electronic musical instruments such as digital pianos to employ sampled sounds of real pianos, rather than attempting to solve Equation 1 (Eq. 1) for a piano tone.

Pursuant to the present embodiment of the invention, the embodiment provides a method of sound analysis to determine timbral characteristics of a first sound signal to derive parameters representative of the timbre, and then thereafter to apply the parameters to a second sound signal to impose upon the second sound signal the timbral characteristics to modify the second sound signal to generate a third sound signal. The third sound signal has timbral nuances to the first sound signal. Practical applications of the method include mimicking the effect of sound processing devices, for example a record mastering effects chain, or non-distorting parts of a guitar amplifier-loudspeaker combination. The parameters representative of the timbre are conveniently, for example, derived by way of obtaining an impulse response. An impulse, for example a Dirac-type pulse, is characterized by having a broad flat spectrum of harmonic components. However, when a system has restricted dynamic range, it is alternatively possible, to a first approximation, to employ a swept frequency signal as a substitute for a Dirac-type pulse.

Tonal coloration caused by acoustic or electrical systems is susceptible to being expressed explicitly using one or more impulse responses. As its name implies, an impulse response represents a system's response to being stimulated by an impulse signal. For an acoustic system, for example a concert hall, the stimulating impulse signal is a temporally abrupt sound of a start pistol, and the corresponding impulse response is the sound of reverberation of the start pistol being fired within the concert hall. By analyzing the impulse response, it is possible to computer parameters representative of the reverberation characteristics of the concert hall, and then to apply the parameters via a mathematical function to sound signals to make them sound as if they were being performed in the concert hall.

In practice, the impulse response is not measured using an impulse signal on account of a low signal-to-noise ratio which would pertain when computing the aforesaid one or more parameters. Alternatively, the impulse response may be derived using a broadband signal source to generate a stimulating signal; "broadband" here means a signal concurrently including a plurality of sinusoidal signal components, for example several thousands sinusoidal components, spread over a broad frequency range from low frequencies, for example 20 Hz, to high frequencies, for example 20 kHz.

With regard to signal processing, when a broadband stimulating signal is employed to stimulate an acoustic system, a corresponding impulse response may be obtained by de-convolving a measured response from the acoustic system to the stimulating signal. The impulse response, represented by one or more parameters is then beneficially applied, pursuant to the present invention, to other sound signals to mimic an acoustic effect of the system. The impulse response can, for example, be represented as a series of signal time delays and signal resonances with associated signal gains and resonance Q-factors. However, computations become more difficult when the system is non-linear when transforming the broadband stimulating signal into an output signal from the system. Such complications arise when the system includes a guitar amplifier output stage, for example when implemented using thermionic vacuum tubes as power amplifying components. Equalization circuitry of an amplifier and microphones tends to add very little non-linearity. However, loudspeakers can add considerable non-linearity when driven at high power levels such that loudspeaker diaphragm movement is a major part of a total mechanical movement range which is possible for the diaphragm (for example defined by diaphragm surround support and voice-coil support arrangement known as a "spiders web support"). A conventional Volterra convolution is susceptible to being employed when the system exhibits non-linearity in its dynamic response, whereas other convolutions are beneficially employed when only linear effects occur.

Pursuant to the present embodiment, it is desirable to copy a timbre of a sound (represented by parameters describing its equivalent impulse response) and apply it to another sound, for example to generate interesting sonic effects in aforesaid albums to render them more appealing in comparison to competing albums. For example, many guitarists are desirous to copy guitar tones from some earlier famous guitarist. Moreover, record producers may be desirous to copy an overall timbre of some given classic record onto a new record on which they are working.

It will be appreciated from the foregoing that exact copying and re-applying timbral characteristics is a technically difficult problem that has hitherto not been adequately addressed, especially not in real time. The present invention enables timbral characteristics to be copied in real time and applied to another sound.

The present embodiment will now be further elucidated with reference to FIG. 1. A method pursuant to the present invention commences by a first step of user-selection of a target sound to represent a desired timbre, such selection being denoted by 10 in FIG. 1. Thereafter, an analysis operation is applied to the target sound. The analysis operation involves a modification of the amplitude spectrum of the target sound denoted by 20; the spectrum of the target sound is modified so that its spectrum resembles that of broadband "pink noise" or similar, namely a flat spectrum with a slope of −3 dB per octave. Thereafter, in a step denoted by 30, a "pink noise" equivalent of the frequency spectrum from the step 20 (S1) is derived; linear prediction is optionally employed when deriving the frequency spectrum from the step 30. The "pink noise" equivalent is essentially the target sound equalized in respect of frequency so that peaks or valleys in the target sound are smoothed out and high frequencies in the target sound are attenuated. Outputs from the steps 10, 30, namely the target sound and its "pink noise" equivalent from the step 30, are applied to a de-convolution function step denoted by 40 (S2) resulting in an impulse response for the target sound being derived as denoted by 50. In practice, the impulse response at the step 50 includes mainly the spectral characteristics of the target sound on account of the "pink noise" equivalent having very neutral timbral characteristics. Finally, the impulse response from the step 50 is stored in a data library, for example in a database. The steps 10, 20, 30, 40, 50 as illustrated in FIG. 1 are conveniently implemented on computing hardware, for example a lap-top computer, using appropriate software products executing upon the computing hardware.

Figure 2:
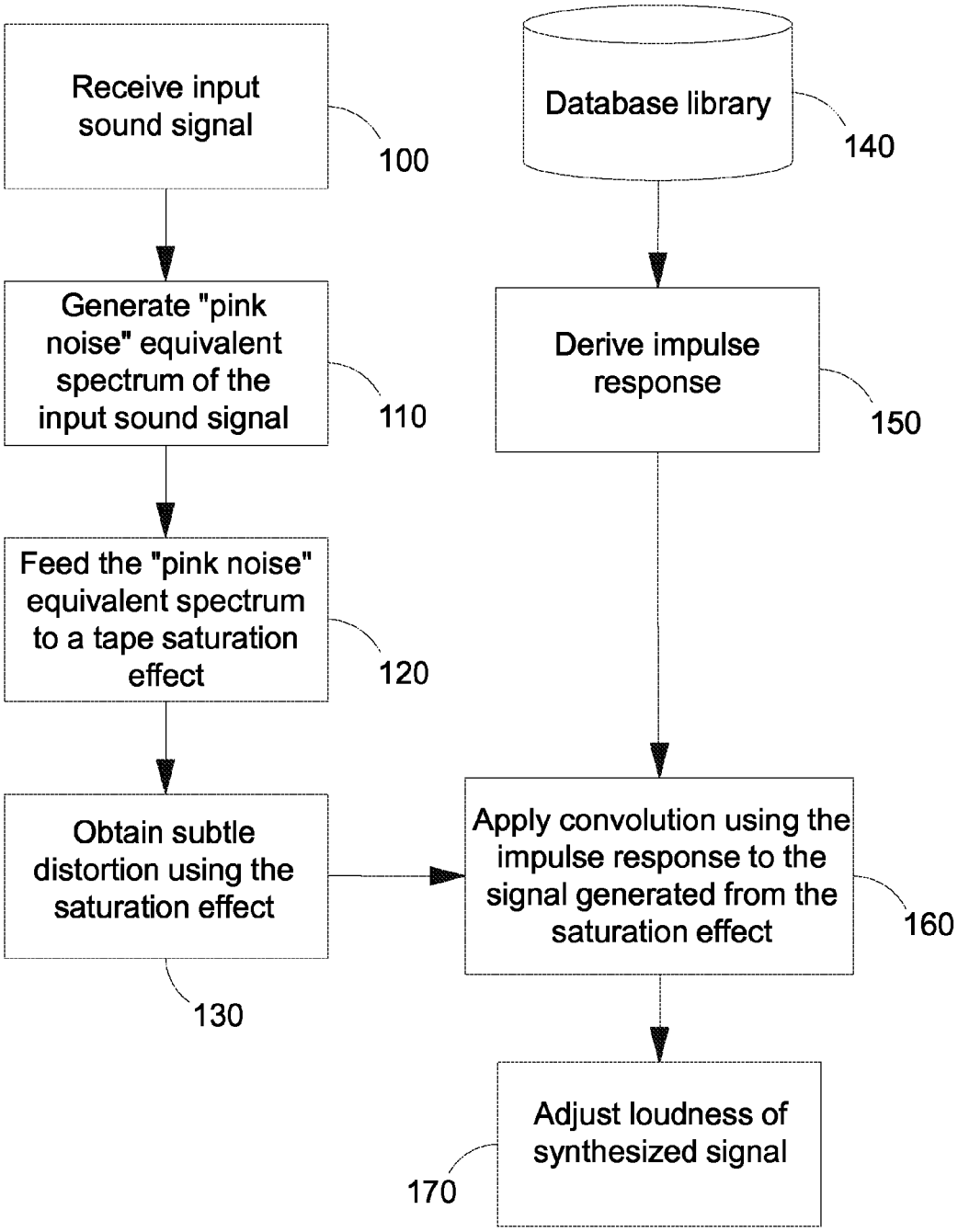
FIG. 2 is an illustration of steps of an embodiment of a sound synthesis method pursuant to the present invention.

The impulse response as derived in an arrangement illustrated in FIG. 1 is susceptible to being applied to other signals by way of steps illustrated in FIG. 2; such application of the impulse response to other signals is conveniently referred to as being a "synthesis phase". In FIG. 2, a step 100 is concerned with receiving an input sound signal whose timbre is to be replaced; the input sound is, for example, an own musical recording in a record-mastering context, but it could alternatively be a user's own distorted guitar signal, for example captured between an amplifier and a loudspeaker in a guitar tone-copy context. In a step 110 (S3), a "pink noise" equivalent spectrum version of the input sound signal is generated; for example, a convolution, a fast Fourier transform (FFT) and recursive filters may be employed in the step 110 for generating the "pink noise" equivalent spectrum. In a step 120, the "pink noise" equivalent spectrum is fed to a tape saturation effect step 130 for obtaining a subtle distortion, reminiscent of a sound effect created by a magnetic tape recorder, for example as was formerly manufactured by Revox company, Switzerland. There is no simple theoretical explanation to explain why it is beneficial to employ the saturation effect step 130 although it is found to be aesthetically highly beneficial. However, depending upon circumstances, the saturation effect step 130 may be substituted for another type of effect step, for example dynamic range compression, or even omitted.

Additionally in FIG. 2, the impulse response 150 by way of a set of parameters is provided from a database library 140; the impulse response 150 is beneficially derived via steps as elucidated with reference to FIG. 1. A convolution operation step 160 (S5) is applied, using the impulse response 150 to determine the convolution, to the signal generated from the saturation effect step 130, or to the "pink noise" equivalent spectrum from the step 110 when the effect step 130 is not employed. The convolution 160 (S5) applies the impulse response to the "pink noise" equivalent spectrum, or "pink noise" equivalent spectrum subject to saturation effect, to generate a version of the input sound signal at the step 100 subject to the timbral characteristics as represented by the impulse response 150. The convolution 160 (S5) is beneficially implemented by a set of resonances and a set of signals delays. Optionally, the convolution 160 is implemented using an FFT/IFFT-based method. More optionally, the convolution 160 includes non-linear transfer functions when the impulse response 150 is representative of a non-linear system, for example a system including a thermionic electron tube power amplifier ("valve amplifier"). More optionally, the average root-mean-square loudness of outputs of steps 10 or 30 in FIG. 1 are estimated, and this average loudness measure is used in adjusting the loudness of the synthesized signal 170 of FIG. 2. Although FIG. 2 is described above in a somewhat off-line manner by way of use of the library database for the impulse response 150, it is feasible to configure steps in FIG. 1 and FIG. 2 to be performed in real-time in a nearly concurrent manner.

The present embodiment is beneficially employed as a record mastering tool, for example for use in aforesaid recording studios. Moreover, the synthesis steps depicted in FIG. 2 are beneficially employed when implementing a guitar speaker simulation, for example a guitar played through a specific type of power amplifier and loudspeaker combination. Both of these applications require real-time operation of at least the steps in FIG. 2.

Optionally, the present embodiment is applied to generate an impulse library of several pre-existing musical records. The synthesis steps of FIG. 2 are then beneficially employed in a mastering phase during production of a new album, such that the timbre of a pre-existing record is applied to the new album. Beneficially, when the present invention is employed in a recording studio, the mastering engineer is capable of continuously listening to a song generated from one or more takes whilst selecting rapidly between different impulse responses, and hence selecting between different sound spectra until a desired aesthetic effect is achieved in the mastered sound for the album. Optionally, after the mastering engineer has identified an aesthetically optimal impulse response 150 to employ, other sound modifying tools are employed, for example loudness maximization algorithms. Optionally, the user is provided by the method represented by FIG. 1 and FIG. 2 an opportunity to input his or her own songs, represented by corresponding impulse responses, into the library database.

As aforementioned, the present embodiment is especially suitable when synthesizing the timbre of "valve" power amplifiers and associated loudspeaker combinations in association with guitar. A users own signal derived from a dummy load applied to an output of an amplifier driven from a guitar is fed through steps of FIG. 2 to impose a timbre corresponding to a famous guitarists, so that the users own signal is convolved to have characteristics recognizable from the famous guitarists.

The present embodiment is capable of providing considering benefits in comparison to known software products for applying sound modification, for example proprietary Nebula effect samplers and similar. Nebula effect samplers employ Volterra-based modeling techniques are not well suited for simulating "valve" amplifiers or distortion effects pedals, due to the computational overcomplexity of synthesizing strongly saturating distortions using the Volterra technique. In the context of the electric guitar, the present invention, used in conjunction with a valve amplifier, is capable of providing a major benefit of only requiring a clip of sound to work with to generate a corresponding impulse response for synthesis, whereas known Volterra-based effects require access to actual devices that are to be simulated.

The present embodiment is susceptible to being manufactured as software products executable upon computing hardware. Moreover, the present invention has technical effect by processing real signals to generate corresponding processing signals having unusual technical characteristics that are also aesthetically pleasing and beneficial when producing tangible products such as albums.

Modifications to embodiments of the invention described in the foregoing are possible without departing from the scope of the invention as defined by the accompanying claims. Expressions such as "including", "comprising", "incorporating", "consisting of", "have", "is" used to describe and claim the present invention are intended to be construed in a non-exclusive manner, namely allowing for items, components or elements not explicitly described also to be present. Reference to the singular is also to be construed to relate to the plural. Numerals included within parentheses in the accompanying claims are intended to assist understanding of the claims and should not be construed in any way to limit subject matter claimed by these claims.

The invention claimed is:

1. A sound analysis and associated sound synthesis method, wherein the method includes:

(a) receiving a first input sound signal;

(b) analyzing the input sound signal to determine its corresponding impulse response representative of a timbre of the input sound signal;

(c) receiving a second input sound signal;

(d) processing the second input sound signal into a form to which the corresponding impulse response is susceptible to being applied, wherein said processing includes generating a "pink noise" equivalent frequency spectrum of the second input sound signal, wherein the "pink noise" equivalent frequency spectrum is a substantially flat frequency spectrum with a slope of −3dB per octave; and (e) applying the impulse response to the processed second input sound signal to generate an output signal, wherein the output sound signal includes at least timbral nuances of the first input sound signal.

2. A method as claimed in claim 1, wherein the method is implemented in real time using software products executing upon computing hardware.

3. A method as claimed in claim 1, wherein multiple impulse responses from (b) are stored on a database, and are user-selectable for applying to the second input sound signal.

4. A method as claimed in claim 1, wherein steps (b) and (e) employ at least one of: signal delay functions, signal resonance functions, non-linear functions, Fourier transform functions.

5. A method as claimed in claim 1, wherein steps (b) and (d) include a signal loudness estimation, for use in step (e) for adjusting the loudness of the processed sound.

6. A method as claimed in claim 1, wherein step (d) includes adding distortion of a form associated with magnetic tape recorders.

7. A method as claimed in claim 1 adapted for applying timbral characteristics corresponding to thermionic electron tube amplifiers.

8. An apparatus operable to execute a method as claimed in claim 1, wherein the apparatus includes:

(a) a receiver for receiving a first input sound signal;

(b) an analyzer for analyzing the input sound signal to determine its corresponding impulse response representative of a timbre of the 5 input sound signal;

(c) a receiver for receiving a second input sound signal;

(d) a processor for processing the second input sound signal into a form to which the corresponding impulse response is susceptible to being applied, wherein said processing includes generating a "pink noise" equivalent frequency spectrum of the second input sound signal, wherein the "pink noise" equivalent frequency spectrum is a substantially flat frequency spectrum with a slope of −3dB per octave; and (e) a processor for applying the impulse response to the processed second input sound signal to generate an output signal, wherein the output sound signal includes at least timbral nuances of the first input sound signal.

9. A software product recorded on a machine-readable data storage medium, wherein the software product is executable upon computing hardware for implementing a method as claimed in claim 1.

* * * * *